US005552763A

United States Patent [19]

Kirby

[11] Patent Number: 5,552,763

[45] Date of Patent: Sep. 3, 1996

[54] FIRE ALARM SYSTEM WITH SENSITIVITY ADJUSTMENT

[75] Inventor: Ronald H. Kirby, Harvard, Mass.

[73] Assignee: Simplex Time Recorder Company, Gardner, Mass.

[21] Appl. No.: 150,696

[22] Filed: Nov. 10, 1993

[51] Int. Cl.[6] ..... G08B 29/00

[52] U.S. Cl. ..... 340/506; 340/501; 340/511; 340/587; 340/588

[58] Field of Search ..... 340/505, 510, 340/511, 514, 518, 501, 506, 587, 588

[56] References Cited

U.S. PATENT DOCUMENTS

| | | | |
|---|---|---|---|
| 4,644,331 | 2/1987 | Matsushita et al. | 340/511 |
| 4,749,987 | 6/1988 | Ishii | 340/511 |
| 4,785,283 | 11/1988 | Yuchi | 340/511 |
| 5,084,696 | 1/1992 | Guscott et al. | 340/511 |
| 5,155,468 | 10/1992 | Stanley et al. | 340/501 |
| 5,172,096 | 12/1992 | Tice et al. | 340/514 |

OTHER PUBLICATIONS

"VESDA Active Detection Before a Fire Starts," VESDA Active Smoke Detection sales brochure, printed Apr. 1994.

VESDA E70–D Manual, pp. 3–3, 3–4 and 3–7, Oct. 1994.

VESDA E70–D Programmable, Intelligent Controlled, Self–Contained, Air Sampling Smoke Detector, sales brochure, printed Nov. 1993.

Cole, M., "Application of Electronics—Sensor Developments—Fire Australia 1993," VESDA Active Smoke Detection, printed May, 1994.

"Today's Wider Range of Fire Detection Problems Requires a Wider Range of Very Early Smoke Detectors," VESDA sales brochure, printed Apr., 1994.

"Stratos™ High Sensitivity Smoke Detector," sales brochure, Air Sense Technology, Ltd., (between Aug. and Oct., 1993).

VESDA E70–D Intelligent Addressable HSSD Detector Operators' Handbook Feb., 1992.

*Primary Examiner*—Jeffery Hofsass
*Assistant Examiner*—Daniel J. Wu
*Attorney, Agent, or Firm*—Hamilton, Brook, Smith & Reynolds, P.C.

[57] ABSTRACT

A fire alarm system automatically adjusts sensitivity of individual sensors based on evaluation of background level over a period of time. High sensor signals which do not trigger a fire alarm may, after a delay time, result in decreased sensitivity to avoid false alarms. On the other hand, low peak values stored over a period on the order of months result in an automatic increase in sensitivity of the system. The sensitivity is adjusted by changing the delta threshold of an alarm threshold over a quiescent sensor signal average.

41 Claims, 3 Drawing Sheets

FIRE ALARM SYSTEM WITH SENSITIVITY ADJUSTMENT

BACKGROUND

The potential for property damage, personal injury and death from hostile fires in buildings increases in proportion to the time it takes to detect the fire. Put another way, the earlier a hostile fire can be detected in a building the less severe will be its consequences.

More sensitive smoke detectors will detect a fire more quickly than less sensitive smoke detectors. In a controlled test environment, described in Underwriter's Laboratories standard 268, a detector set at 0.5% obscuration per foot will repeatedly detect smoke in the "smoldering fire room test"14 to 17 minutes faster than the same detector set at 3.7% obscuration per foot. More sensitive smoke detectors are, however, more prone to false alarms than less sensitive detectors. The challenge, then, is to match the individual detector sensitivity to the environment where it is installed so as to minimize the time to detect a fire and to do so without causing false alarms.

The Simplex TrueAlarm™ smoke detection system disclosed in U.S. Pat. No. 5,155,468 allows a user to set the sensitivity of each detector in the system. Sensitivity is determined by a threshold value above which an alarm is sounded, that threshold being computed from a user selected delta threshold added to a normal base level. In the TrueAlarm system, that normal base level is computed as a running average of the background sensor signal.

The system has the ability to display, on command from the system's history log, the actual maximum percent of the alarm level experienced as background at every smoke sensor location since the history log for the sensor was last reset. For example, if a smoke detector system monitoring a particular environment were programmed to a 3% per foot sensitivity and, at some time during the period the sensor was being monitored, actual smoke in that environment reached 1% per foot obscuration, the panel display would show that the maximum actual value for that sensor during that time period reached 33% of its alarm setpoint.

Thus, a user may periodically check the maximum percent and adjust the sensitivity of the detector accordingly. For example, if the maximum percent over a period of time is very close to the alarm threshold, one might conclude that the environment naturally provides sensor signals which are too close to the present threshold. The sensitivity of the detector would be reduced to avoid false alarms by increasing the delta threshold. On the other hand, if the maximum percent is always very low, the sensitivity could be increased for more rapid response to a fire without risking false alarms.

SUMMARY OF THE INVENTION

Because manually calling up the peak percent of alarm experience at each smoke sensor and then manually resetting the sensitivity is labor intensive, it is seldom done. As a consequence, most installed smoke detectors are operating at lower sensitivity settings than is appropriate for their environments.

In accordance with the present invention, a fire detection system monitors sensor signals relative to thresholds and automatically corrects sensitivity to individual sensors to maintain rapid response without false alarms. Accordingly, a fire alarm system comprises at least one fire sensor providing a sensor signal for monitoring an ambient condition. For example, the sensor may be a photosensitive smoke detector or a temperature sensitive heat detector. Processor electronics such as a programmed controller indicate an alarm condition when the sensor exceeds a threshold value. The threshold value is variable by the processor to adjust the sensitivity of the alarm system to the sensor signal while the processor monitors for an alarm condition.

In the preferred system, the threshold is adjusted responsive to sensor signal peaks. The threshold is preferably the sum of the delta threshold and a quiescent sensor signal average. The processor increases sensitivity with low sensor signal peaks over a period of time, the period of time being in the order of months. The processor decreases sensitivity a delay time after a high peak value, the delay time being in the order of days.

In the most preferred system, the delta threshold is decremented to increase sensitivity when the peak percent obscuration per foot is less than the about 0.2 times the threshold percent obscuration per foot and is incremented to decrease sensitivity when the peak obscuration per foot exceeds 0.5 times the threshold percent obscuration per foot.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
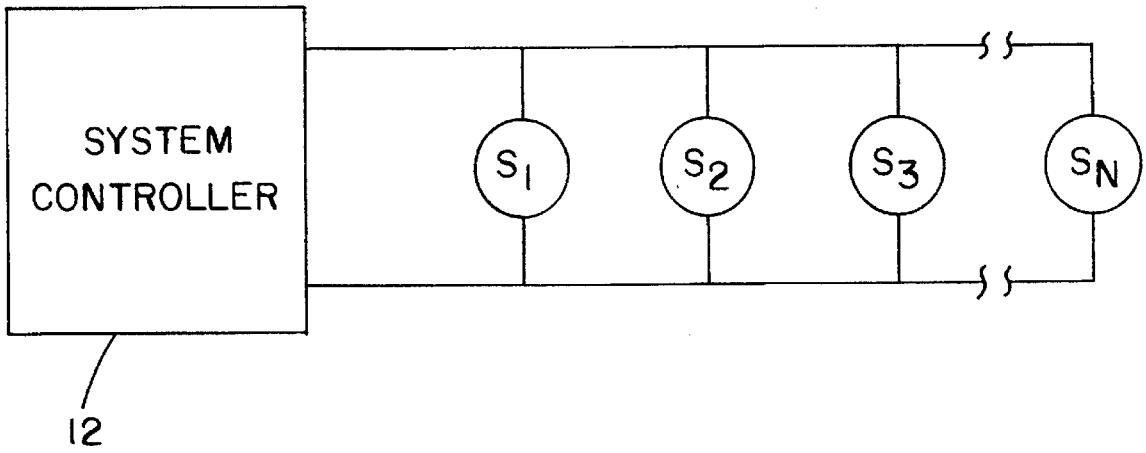
FIG. 1 illustrates a fire alarm system embodying the present invention.

As illustrated in FIG. 1, the present invention is particularly applicable to a fire alarm system comprising multiple fire sensors S coupled to a central system controller 12. A preferred system is that presented in U.S. Pat. No. 5,155,468 to Stanley et al. In that system, the system controller 12 periodically polls each sensor to read a sensor signal. The sensor signal, indicative of an environmental condition such as smoke or temperature, is compared to a threshold value to determine whether an alarm condition should be sounded. In a preferred system, that threshold is the sum of a user selected delta-threshold value and a sensor signal running average as described in Stanley et al patent. The running average serves as a quiescent threshold base which varies with condition of the sensor over time. For example, as a photodetector becomes dirty, the average sensor signal increases.

Figure 2:
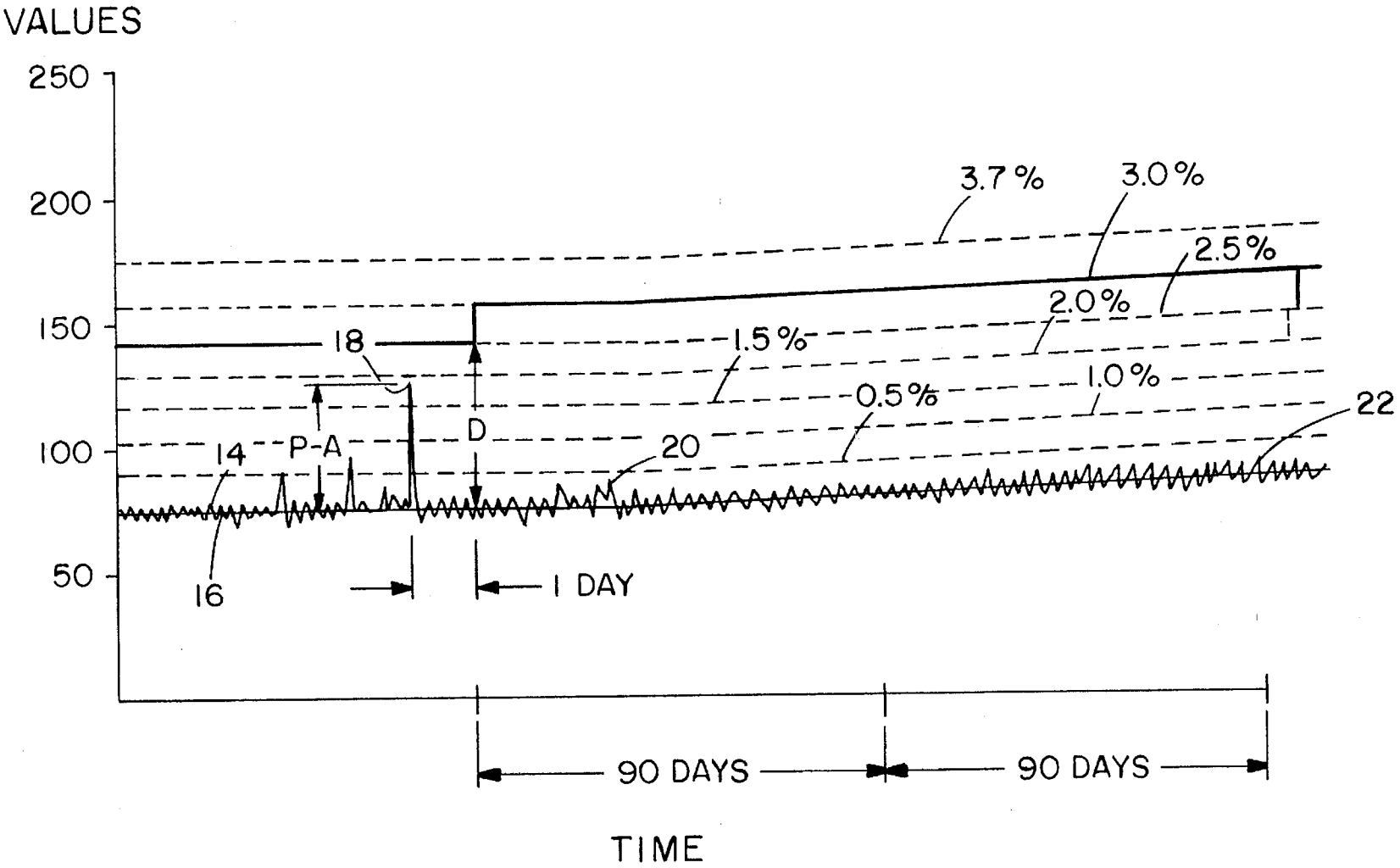
FIG. 2 is an illustration of threshold values relative to test values in a system performing in accordance with the present invention.

The delta value is preferably defined in increments of 0.5 percent obscuration per foot as illustrated in the table and in FIG. 2. The sensor signals and thus the running average and delta threshold values are quantization values corresponding to the 256 possible levels defined by an eight-bit digital byte. The actual values corresponding to percent obscuration are selected in the design of the system. The running average of sensor signals of a typical sensor would be about 75 when new.

TABLE

| %/Ft. | Delta-Threshold |
|---|---|
| 0.5 | 15 |
| 1.0 | 28 |
| 1.5 | 42 |
| 2.0 | 55 |
| 2.5 | 68 |
| 3.0 | 82 |
| 3.5 | 98 |
| 3.7 | 100 |

FIG. 2 illustrates varying sensor signals 14 along the running average 16. Since the running average is averaged over a long period of time such as 30 days, it changes very slowly with time. The levels of the available thresholds, equal to delta thresholds added to the running average, are illustrated in broken lines. As illustrated to the right of FIG. 2, and in accordance with the approach presented in U.S. Pat. No. 5,155,468, the thresholds rise as the running average rises.

In accordance with the present invention, the sensor signals 14 over a period of time are used to adjust the sensitivity of the detector; that is, the delta threshold may be incremented to decrease sensitivity or decremented to increase sensitivity. Whether the sensitivity should be changed is determined from the level of the peak value P over the running average A relative to the delta threshold value D. Depending on how one weighs the need for rapid response to a fire against the danger of false alarms, different cut-off ratios can be selected by a user. In general, it is preferred that sensitivity be increased where the ratio is less than a cut-off in the range of 0.1 to 0.4, and that sensitivity be decreased where the ratio is greater than a cut-off in a corresponding range of 0.4 to 0.7. In a preferred system, (P-A)/D ratios of 0.2 and 0.5 have been selected as the cut-off ratios for increasing and decreasing the sensitivity. Specifically, if the ratio is less than 0.2 over a period of time, the sensitivity can be increased 0.5% obscuration per foot without fear of creating false alarms. On the other hand, if the ratio is greater than 0.5 at any time when a fire condition does not exist, the risk of false alarms is too great and the sensitivity is decreased by 0.5% obscuration per foot. The user may also select minimum and maximum sensitivity levels. For example, a user may choose not to allow the system to drop below a 1% obscuration per square foot sensitivity threshold for fear of false alarms, notwithstanding low peak values.

Relatively long periods of time in the order of months are preferred for monitoring peaks to increase sensitivity. The same period of time can be used in decreasing sensitivity; however, to avoid false alarms, it is preferred that the system respond to high peaks relatively rapidly, preferably on the order of days after a high peak. To be assured that a high peak value is not leading to a fire condition, a delay time of at least about a day is allowed after a high peak before decreasing sensitivity.

In the illustration of FIG. 2, a peak 18 is about 127. That peak may have been due to someone smoking under the sensor or any other condition which did not rise to the level of a fire. The value (P-A), which is the difference between the peak value and the running average, is thus about 52. Since the system had been set at a sensitivity of 2.5% obscuration per foot, the delta threshold value D from the table would be 68. Thus the ratio R of (P-A)/D is about 0.76. That value approximates the ratio of peak percent obscuration to threshold percent obscuration. The peak 18 is greater than 0.5 and is thus considered to be too close to the then existing threshold, presenting too great a risk of false alarms during conditions such as at the peak 18 during which a fire does not exist. Accordingly, after a one day delay to assure that a fire does not exist the threshold is incremented to the next threshold level, or 3% obscuration per foot. At the same time, the stored peak value is reset to zero.

Thereafter, through the next 90 days, each sensor signal which is received from the sensor and which is greater than the stored peak value replaces the stored peak value so that at the end of the next 90 days, the peak during that 90 day period remains stored. As illustrated in FIG. 2, during the next 90 days, a high peak value which would provide a ratio greater than 0.5 and thus cause a decrease in sensitivity and reset of the system does not occur. At the end of the 90 days, the stored peak 20 of about 85 results in a (P-A) value of about 20. The ratio of (P-A) to the delta threshold value D at 3% obscuration per foot is about 0.24. That ratio is considered to be at an appropriate level to provide sufficient sensitivity to fires without risking false alarms, so there is no adjustment to the threshold level at 180 days. The peak value is reset at that time.

During the next 90 days illustrated in FIG. 2, the peak value at 22 is again at about 95. However, the running average at the end of this period of time is up to about 85, so the ratio of (P-A) to the delta threshold of 82 is about 0.12. That peak level is considered to be sufficiently below the then existing threshold that the system can tolerate an increase in sensitivity without danger of false alarms. Thus, the delta threshold is reduced again to 68 at the 2.5 percent obscuration per foot sensitivity level.

Figure 3:
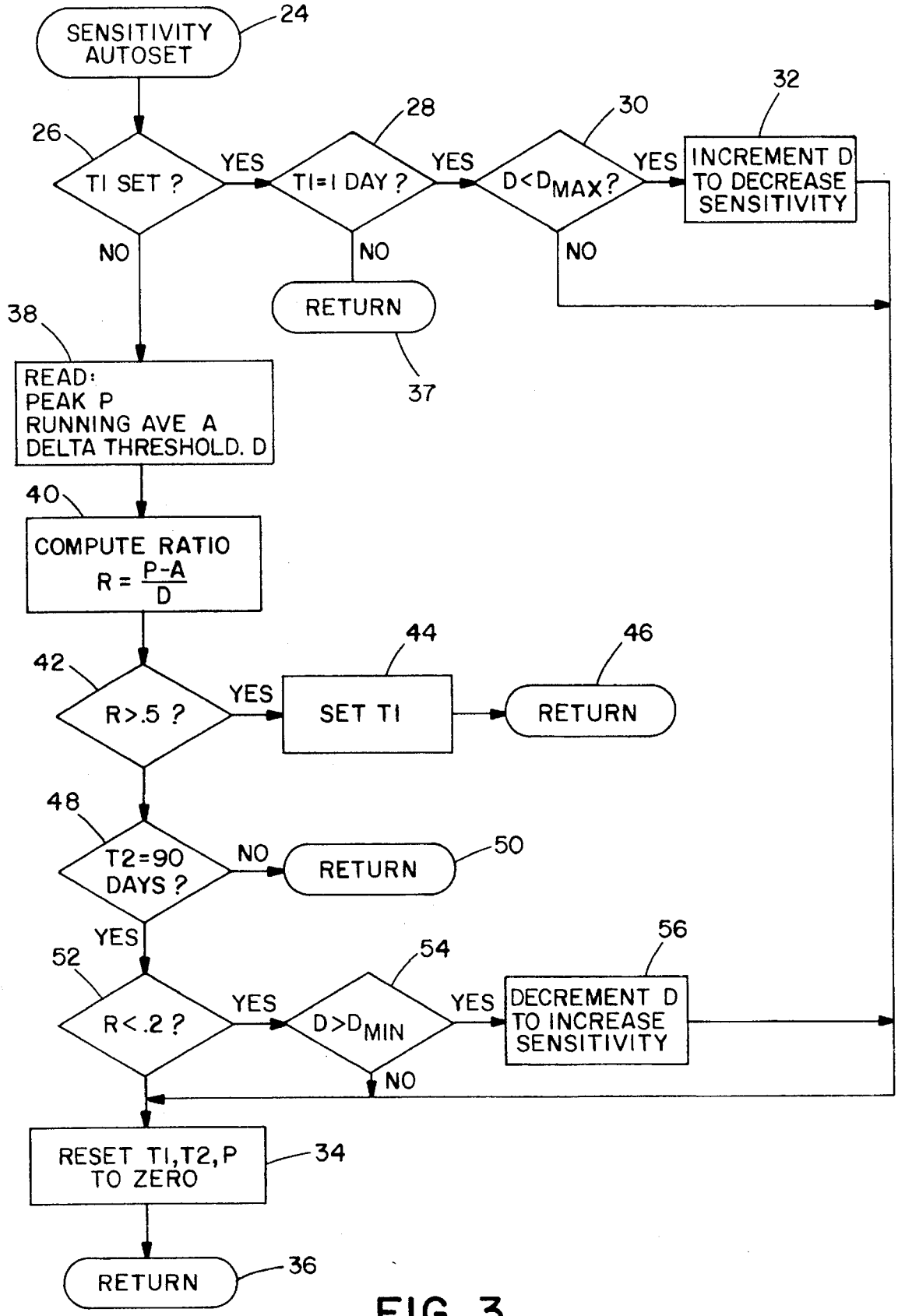
FIG. 3 is a flow chart of a software program for implementing the present invention.

A flow chart presenting one implementation of the sensitivity autoset of the present invention is presented in FIG. 3. This routine is periodically called by the controller to check the value R. If the value R is greater than 0.5 the routine initiates a delay time of one day to determine whether a fire condition exists. If a fire alarm is sounded the sensitivity autoset variables are reset to zero. However, if a day passes without an alarm the sensitivity is decreased to avoid false alarms. On the other hand, if 90 days pass without a high peak, and the highest peak results in a ratio R of less than 0.2, the system deceases sensitivity. The sensitivity autoset routine variables are reset to zero at least every 90 days.

The sensitivity autoset routine is called at 24. The system then checks at 26 whether a time delay T1 was previously initiated (set) by a previous call of the routine which calculated a ratio R greater than 0.5. If the time delay T1 has been set, the system checks at 28 whether a full day has passed. If not, the system returns to the main routine from which it will return to the sensitivity autoset subroutine at a later time. If one day has passed since the time delay was set, the system checks at 30 whether the delta threshold D is less than the maximum delta threshold set by the user. If so, the system increments the delta threshold D at 32 to decrease sensitivity of the system. If the delta threshold already equals the maximum set by the user, the threshold remains at that maximum. In either case, the sensitivity autoset variables are reset at 34 and the system returns to the main controller routine at 36.

If the delay time T1 had not been previously set at 26, the system would continue to 38 to read the peak sensor signal value P stored since last reset of the sensitivity autoset variables and to read the running average A and the delta threshold D. At 40, the system computes the ratio R=(P-A)/D. At 42 the system determines whether that computed ratio exceeds 0.5. If it does, the delay time T1 is set at 44 and the system returns to the main program for later return to the sensitivity autoset subroutine. As described above with respect to program steps 28, 30 and 32, once the delay time T1 has been set, the system attempts to decrease sensitivity after one day unless an alarm condition has previously reset the T1 variable.

If the value R does not exceed 0.5 at 42, the system checks to determine whether 90 days have passed since last reset of the autoset variables. If not, the system returns to the main routine at 50. If 90 days have passed, the system determines whether the ratio R is less than 0.2 at 52. If so, it checks at 54 whether the delta threshold value D exceeds the minimum D specified by the user. If so, sensor sensitivity is increased by decrementing D at 56. In any case, the sensitivity autoset variables T1, T2 and P are reset to zero at 34 and the system returns to the main program at 36.

While this invention has been particularly shown and described with references to preferred embodiments thereof, it will be understood by those skilled in the art that various changes in form and details may be made therein without departing from the spirit and scope of the invention as defined by the appended claims. For example, the system variables and threshold increments may be varied, and the system may base decisions on actual peak and threshold values rather than the (P-A) and delta threshold values. Or the (P-A) value may be continuously computed and stored rather than storing the peak values and computing (P-A) at the end of each measurement cycle.

What is claimed is:

1. A fire alarm system comprising:

a fire sensor providing a sensor signal for monitoring an environmental condition; and a processor which indicates an alarm condition when the sensor signal exceeds an alarm threshold, the alarm threshold being variable by the processor to adjust sensitivity of the alarm system to the sensor signal, the processor automatically adjusting the threshold over time responsive to individual sensor signal peak values while monitoring for an alarm condition.

2. A fire alarm system as claimed in claim 1 wherein the alarm threshold is the sum of a delta threshold and a quiescent sensor signal average and the threshold is adjusted by adjusting the delta threshold.

3. A fire alarm system as claimed in claim 1 wherein the processor increases sensitivity with low sensor signal peaks over a period of time.

4. A fire alarm system as claimed in claim 3 wherein the processor decreases sensitivity a delay time after a high peak value.

5. A fire alarm system as claimed in claim 4 wherein the threshold is the sum of a delta threshold and a quiescent sensor signal average.

6. A fire alarm system as claimed in claim 5 wherein the period of time is in the order of months.

7. A fire alarm system as claimed in claim 6 wherein the delay time is in the order of days.

8. A fire alarm system as claimed in claim 7 wherein the monitored environmental condition is percent obscuration per foot and the delta threshold is decremented to increase sensitivity when a peak percent obscuration per foot is less than a value of about 0.2 times the threshold percent obscuration per foot and is incremented to decrease sensitivity when the peak percent obscuration per foot exceeds about 0.5 times the threshold percent obscuration per foot.

9. A fire alarm system as claimed in claim 5 wherein, within each of successive periods of time, a peak value sensed during the period of time is stored for a comparison, and the stored peak value is reset to zero at the end of each period of time.

10. A fire alarm system comprising:

a fire sensor providing a sensor signal for monitoring an environmental condition; and a processor which indicates an alarm condition when the sensor signal exceeds an alarm threshold which is a delta threshold over a varying quiescent sensor signal level, the delta threshold being variable by the processor to adjust sensitivity of the alarm system to the sensor signal, the processor automatically adjusting the delta threshold over time responsive to the sensor signal while monitoring for an alarm condition.

11. A fire alarm system comprising:

a fire sensor providing a sensor signal for monitoring an environmental condition; and a processor which indicates an alarm condition when the sensor signal exceeds an alarm threshold which is a delta threshold over a varying quiescent sensor signal level, the delta threshold being variable by the processor to adjust sensitivity of the alarm system to the sensor signal, the processor automatically adjusting the delta threshold over time responsive to the sensor signal while monitoring for an alarm condition, the processor increasing sensitivity with low sensor signal peaks over a period of time.

12. A fire alarm system as claimed in claim 11 wherein the processor decreases sensitivity a delay time after a high peak value.

13. A fire alarm system as claimed in claim 12 wherein the period of time is in the order of months.

14. A fire alarm system as claimed in claim 13 wherein the delay time is in the order of days.

15. A fire alarm system comprising:

a fire sensor providing a sensor signal for monitoring an environmental condition; and a processor which indicates an alarm condition when the sensor signal exceeds an alarm threshold, the threshold being the sum of a delta threshold and a quiescent sensor signal average, the delta threshold being incremented to decrease sensitivity a delay time after a high peak sensor signal and being decremented to increase sensitivity at the end of a period of time where a stored peak sensor signal is low during the period of time, the stored peak value being reset at the end of the delay time and at the end of the period of time.

16. A method of detecting a fire comprising:

converting an ambient condition to a sensor signal;

electronically indicating an alarm condition when the sensor signal exceeds a threshold; and electronically varying sensitivity relative to the sensor signal by adjusting the threshold over time responsive to peak sensor signals while monitoring for an alarm condition.

17. A method as claimed in claim 16 further comprising electronically setting the threshold as the sum of a delta threshold and a quiescent sensor signal average, the threshold being adjusted by adjusting the delta threshold.

18. A method as claimed in claim 16 wherein the processor increases sensitivity with low sensor signal peaks over a period of time.

19. A method as claimed in claim 18 wherein the processor decreases sensitivity a delay time after a high peak value.

20. A method as claimed in claim 19 further comprising electronically setting the threshold as the sum of a delta threshold and a quiescent sensor signal average.

21. A method as claimed in claim 20 wherein the period of time is in the order of months.

22. A method as claimed in claim 21 wherein the delay time is in the order of days.

23. A method as claimed in claim 22 wherein the monitored condition is percent obscuration per foot and the threshold is decremented to increase sensitivity when a peak percent obscuration per foot is less than a value of about 0.2 times a threshold percent obscuration per foot and is incremented to decrease sensitivity when the peak percent obscuration per foot exceeds about 0.5 times the threshold percent obscuration per foot.

24. A method as claimed in claim 20 further comprising, within each of successive periods of time, storing a peak value sensed during the period of time, and resetting the peak value to zero at the end of each period of time.

25. A method of detecting a fire comprising:

converting an ambient condition to a sensor signal;

electronically indicating an alarm condition when the sensor signal exceeds an alarm threshold, the alarm threshold being a delta threshold over a varying quiescent sensor signal level; and electronically varying sensitivity relative to the sensor signal by adjusting the delta threshold over time responsive to the sensor signal while monitoring for an alarm condition.

26. A method of detecting a fire comprising:

converting an ambient condition to a sensor signal;

electronically indicating an alarm condition when the sensor signal exceeds an alarm threshold, the alarm threshold being a delta threshold over a varying quiescent sensor signal level;

electronically varying sensitivity relative to the sensor signal by adjusting the delta threshold over time responsive to the sensor signal while monitoring for an alarm condition; and electronically increasing sensitivity with low sensor signal peaks over a period of time.

27. A method as claimed in claim 26 further comprising electronically decreasing sensitivity a delay time after a high peak value.

28. A method as claimed in claim 27 wherein the period of time is in the order of months.

29. A method as claimed in claim 28 wherein the delay time is in the order of days.

30. A fire alarm system comprising:

a fire sensor providing a sensor signal for monitoring percent obscuration per foot; and a processor which indicates an alarm condition when the sensor signal exceeds an alarm threshold, the alarm threshold being the sum of a delta threshold and a quiescent sensor signal average, the processor automatically adjusting the delta threshold over time responsive to sensor signal peaks while monitoring for an alarm condition to adjust sensitivity of the alarm system to the sensor signal, delta threshold being decremented to increase sensitivity when a peak percent obscuration per foot is less than a first percentage of a threshold over a period of time and is incremented to decrease sensitivity a delay time after a peak value when the peak percent obscuration per foot exceeds a second percentage of the threshold.

31. A fire alarm system as claimed in claim 30 wherein the period of time is in the order of months.

32. A fire alarm system as claimed in claim 31 wherein the delay time is in the order of days.

33. A fire alarm system as claimed in claim 32 wherein, within each of successive periods of time, a peak value sensed during the period of time is stored for comparison, and the stored peak value is reset to zero at the end of each period of time.

34. A fire alarm system as claimed in claim 30 wherein, within each of successive periods of time, a peak value sensed during the period of time is stored for comparison, and the stored peak value is reset to zero at the end of each period of time.

35. A fire alarm system as claimed in claim 30 wherein the first percentage is about 20% and the second percentage is about 50%.

36. A method of detecting a fire comprising:

converting an ambient condition to a sensor signal;

electronically indicating an alarm condition when the sensor signal indicates percent obscuration per foot exceeding an alarm threshold, the alarm threshold being a delta threshold over a varying quiescent sensor signal level; and electronically varying sensitivity relative to the sensor signal by adjusting the delta threshold over time responsive to the sensor signal while monitoring for an alarm condition, the threshold being decremented to increase sensitivity when a peak percent obscuration per foot is less than a first percentage of a threshold over a period of time and is incremented to decrease sensitivity a delay time after a peak value when the peak percent obscuration per foot exceeds a second percentage of the threshold.

37. A method as claimed in claim 36 wherein the period of time is in the order of months.

38. A method as claimed in claim 37 wherein the delay time is in the order of days.

39. A method as claimed in claim 38 further comprising, within each of successive periods of time, storing a peak value sensed during the period of time, and resetting the peak value to zero at the end of each period of time.

40. A method as claimed in claim 36 further comprising, within each of successive periods of time, storing a peak value sensed during the period of time, and resetting the peak value to zero at the end of each period of time.

41. A method as claimed in claim 36 wherein the first percentage is about 20% and the second percentage is about 50%.

* * * * *